United States Patent [19]

Mykleby

[11] 4,339,039

[45] Jul. 13, 1982

[54] IMPACT RESISTANT FOAM CUSHIONED PACKAGES

[75] Inventor: Laurie G. Mykleby, Palos Park, Ill.

[73] Assignee: First National Packaging Co., Inc., Palos Park, Ill.

[21] Appl. No.: 172,276

[22] Filed: Jul. 25, 1980

[51] Int. Cl.[3] ..... B65D 81/04; B65D 85/30

[52] U.S. Cl. ..... 206/523; 206/591; 206/594; 220/445

[58] Field of Search ..... 206/523, 591, 594, 521; 220/445

[56] References Cited

U.S. PATENT DOCUMENTS

| | | | |
|---|---|---|---|
| 848,889 | 4/1907 | Fitzgerald | 206/591 |
| 1,601,547 | 9/1926 | Wofford | 206/591 |
| 1,792,627 | 2/1931 | Bowersock | 206/591 |
| 2,979,246 | 4/1961 | Liebeskind | 206/523 |

*Primary Examiner*—William T. Dixson, Jr.
*Attorney, Agent, or Firm*—Thomas W. Speckman

[57] ABSTRACT

A cushion for packaging an article in a container comprising flexible foam material and a pliable non-porous cover contiguously surrounding the foam material. The cover may include a lip which may be secured to the container. A plurality of air vents in the cover adjacent the lip control the flow of air out of the cover when the foam is compressed. By controlling the air flow out of the foam material, the dynamic resistance of the cushion may be increased, so that more force is absorbed by the cushion when an external force is applied to the container than would be absorbed if exposed foam material were used. A plurality of cushions may be secured to the inside of the container to hold the article snugly in place.

12 Claims, 2 Drawing Figures

IMPACT RESISTANT FOAM CUSHIONED PACKAGES

BACKGROUND OF THE INVENTION

This invention relates to foam cushions, and more particularly to foam cushions with improved dynamic resistance characteristics.

Fragile articles, such as electronic equipment and the like, must be packaged properly during shipment to prevent damage to the articles. The package must support its contents in the static condition, when it is stationary, and must absorb a substantial portion of external forces which may be exerted on the package if it is jostled or dropped. The ability of the package to absorb such external forces may be expressed as its dynamic resistance characteristic.

Various forms of plastic materials may be used to package fragile articles. Plastic beads may be placed around the article by covering the bottom of a container with beads, placing the article to be shipped on the beads in the center of the container, and filling the rest of the container with beads. A substantial amount of plastic is used, however, and if the article is not correctly placed in the container, or if the beads shift in the container, there may not be enough beads on a particular side of the package, which could result in damage to the article. Also, the beads and all related equipment must be stored and maintained near the packing area, and the packages cannot be prepared in advance of shipment. These conditions are inefficient, especially on assembly lines, and may reduce productivity and delay shipments. In addition, the beads are often discarded after shipment, and are not reused.

The plastic beads may be loosely encased in a plastic sack as described in U.S. Pat. No. 3,462,007. Air escapes from the sack through perforations so that the article is cushioned by the beads.

The quantity of plastic used in packaging may be reduced substantially by using pieces of flexible foam material instead of beads. However, as the quantity of plastic is reduced, the amount of force which it will absorb, or its dynamic resistance characteristic, decreases. Several foam structures have been developed which increase the dynamic resistance characteristic of foam, as seen in U.S. Pat. Nos. 3,607,601, 3,954,537, 4,062,712, 4,147,825 and 3,345,245. However, these structures include more than one layer of foam material, which requires relatively substantial fabrication machinery and techniques. Thus, there is a need for foam structures which package articles with a minimum amount of plastic and relatively simple fabrication machinery and techniques, and have an improved dynamic resistance characteristic.

One or more foam structures may be used in connection with a container to package an article. U.S. Pat. Nos. 3,602,376, 3,690,540, 3,173,535, 3,275,131 and 3,471,116 describe various packages which use foam plastic or the like to package articles. However, none of the patents describe packages which have an improved dynamic resistance characteristic. Thus, there is a need for packages which use foam plastic or the like and have an improved dynamic resistance characteristic.

Accordingly, an object of the present invention is to provide new and improved packages and structures for packaging.

Another object is to provide new and improved foam cushions for packaging articles which use a reduced quantity of reusable plastic and may be relatively easily fabricated.

Yet another object is to provide new and improved packages which use a reduced quantity of reusable plastic and have an improved dynamic resistance characteristic.

In keeping with one aspect of the invention, a plurality of cushions are secured inside of a packing container in a pre-determined array. Each cushion has a piece of flexible foam material and a pliable plastic cover which contiguously surrounds the cushion on all sides. The bottom surface of the cushion may also be covered, if desired, and a lip may be provided on the cover to secure the cushion to the container. A plurality of air vents are provided in the cover near the lip to control the flow of air from the cushion when the foam is compressed.

BRIEF DESCRIPTION OF THE DRAWINGS

The above mentioned and other features of this invention and the manner of obtaining them will become more apparent, and the invention itself will be best understood by reference to the following description of embodiments of the invention taken in conjunction with the accompanying drawings, in which.

DESCRIPTION OF THE PREFERRED EMBODIMENTS

Figure 1:
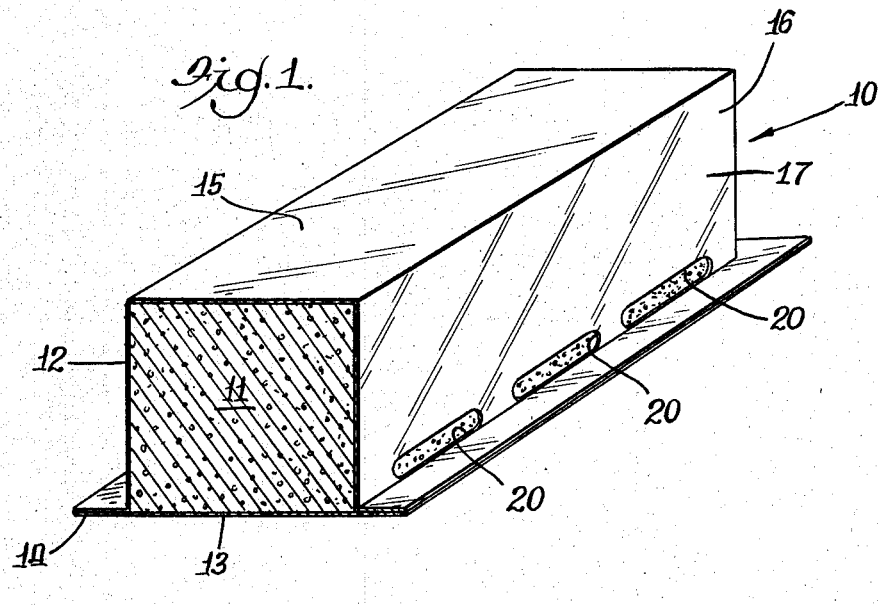
FIG. 1 is a partially cutaway perspective view of the inventive cushion.

A cushion 10 (FIG. 1) includes a piece of flexible foam 11, and a contiguous cover 17 made of pliable, non-porous plastic. The foam 11 may be any suitable shape, including the generally block shape shown in FIG. 1. The cover 17 conforms generally to the shape of the foam 11, with little or no air space between the foam 11 and the cover 17.

Figure 2:
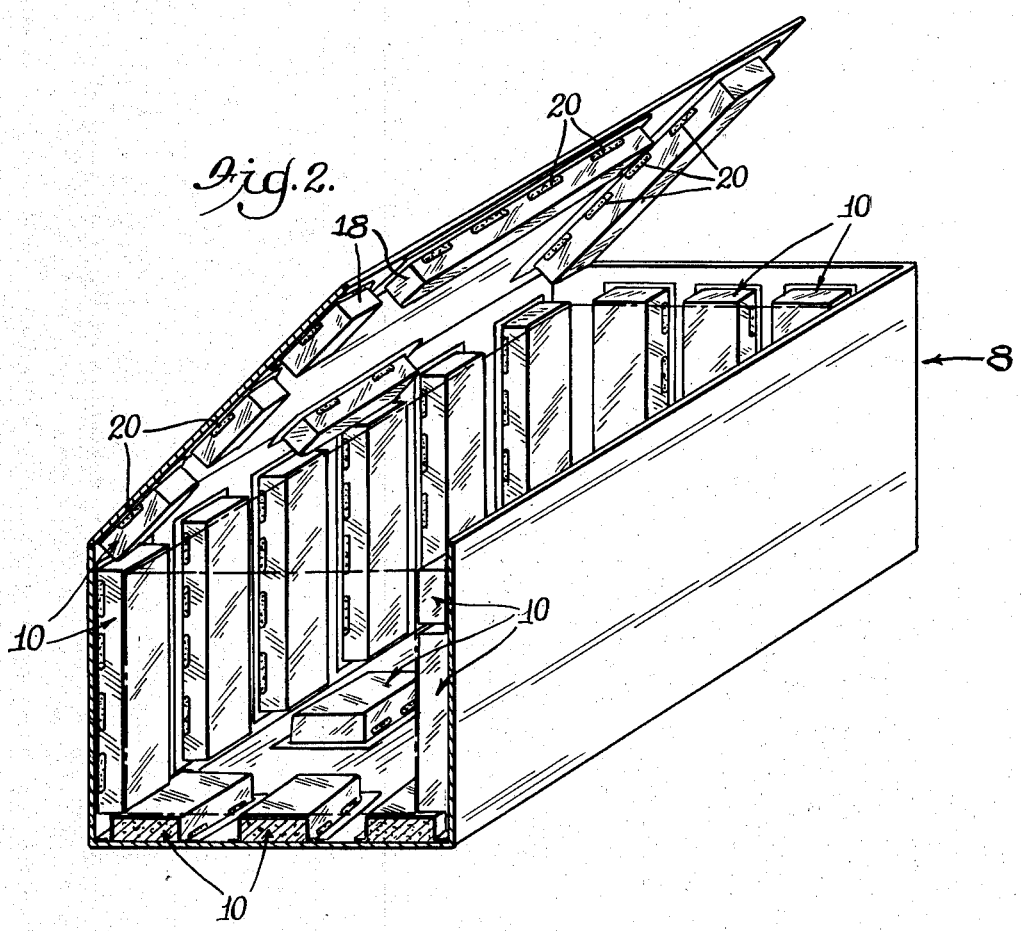
FIG. 2 is a partially cutaway perspective view of a container which includes a plurality of the inventive cushions of FIG. 1.

The cover 17 includes a first side 12, a top 15, a second side 16, and ends 18 (FIG. 2). A bottom 13 (FIG. 1) may also be provided on cover 17, if desired. Also, a lip 14 may be provided around the bottom of the cover 17 to secure the cushion 10 to a container 8 (FIG. 2).

A plurality of air vents 20 may be provided around the lower edge of the sides 12, 16 and ends 18. The vents 20 may be any suitable size, provided that they are not so large that they substantially weaken the cover 17.

The vents 20 should be small enough so that the flow of air out of foam 11 during compression is properly controlled. When normal or anticipated forces are exerted on the package, the cushion should compress enough to absorb a substantial portion of the external force, but should not compress so much that force is effectively transmitted directly from the container to the article. Cushion compression is related to the flow of air out of the foam 11, which is controlled by the size and number of vents 20.

A plurality of cushions 10 (FIG. 2) are secured to the inside of a container 8 by any suitable means, such as glue, or the like. The container 8 may be made of any suitable material, including wood or cardboard. The size of the container 8 is determined by the size of the article to be stored therein, which should be held snugly in place by the cushions 10 when the container 8 is closed, but should not compress the cushions 10 excessively. The size and number of cushions 10 will vary with the size and weight of the article being packaged. The space occupied by the cushions 10 will be much less than the space which would be required for an equivalent quantity of other packing materials, such as plastic beads or plain foam. After shipment, the entire package may be easily stored and later reused, or the cushions 10 may be removed from the container 8 and used for another purpose.

In operation, the cushions 10 support the article being packaged in container 8 in the stationary, or static condition. If an external force is applied to the outside of the container 8, such as when the container is dropped onto the floor, a dynamic force is transferred through the container 8 and cushions 10 to the article in the container. The magnitude of the dynamic force applied to the article in relation to the force applied to the container 8 is essentially a function of the dynamic resistance of the cushions 10. The dynamic resistance of the cushions 10 is greater than that of the foam 11 because the cover 17 limits the rate at which air escapes from the open cells of the foam 11. The rate of air escape may be controlled by varying the number and size of the air vents 20 in cover 17.

The increased dynamic resistance imparted by the cover 17 allows the cushion to absorb a substantial portion of the force applied to the container 8, and also reduces the distance which the cushion 10 collapses upon impact. Under normal or expected conditions, this prevents the foam from compressing so much that forces may be effectively transmitted directly from the container to the article.

In a unit actually made and tested, the foam 11 was a piece of polyurethane material two inches high, measuring. three inches on one side and four inches on the other side. The cover 17 was made of PVC plastic material, and had ten vents 20 around the bottom perimeter of the cover 17. Each vent 20 was approximately three-quarter inch in length and one-quarter inch high.

An article dropped twenty-four inches several times on a foam piece without a cover 17 transmitted an average force of 50 G (1 G is the force of gravity) to the bottom surface of the cushion. When the same article was dropped twenty-four inches several times using a foam piece which included the cover 17 just described, an average force of approximately 39 G was transmitted to the bottom surface. Thus, the foam piece which had a cover absorbed over 21 percent more force than the foam piece alone.

The many advantages of this cushion are now self-apparent. The use of a piece of flexible polyurethane foam reduces the size and number of cushions required while providing sufficient static resistance to support an article in a container when the container is stationary. The rate at which air escapes from the foam pieces may be controlled by enclosing each foam piece in a cover having a plurality of air vents of a pre-determined number and size. The cushions may be secured to the inside of the container in pre-determined places, so that all sides of the article being packaged are protected, and the package may be prepared away from the shipping area. Both the package and the cushions may be reused at a later time, if desired.

Any flexible polymeric foam material providing desired cushioning and resilience properties is suitable for the cushions of this invention, such as open or closed cell foams. Open cell foams are preferred. Any flexible sheet material which is generally impervious to rapid air flow is suitable for the cushion covers contemplated by this invention. A wide variety of suitable materials are known to the art.

While in the foregoing specification this invention has been described in relation to certain preferred embodiments thereof, and many details have been set forth for purpose of illustration, it will be apparent to those skilled in the art that the invention is susceptible to additional embodiments and that certain of the details described herein can be varied considerably without departing from the basic principles of the invention.

I claim:

1. A cushion having improved dynamic resistance to applied forces for packaging an article in a container comprising: compressible foam material; pliable non-porous covering means contiguously covering said foam material; and air flow controlling means in said covering means controlling the escape of air from said foam material when said foam material is compressed.

2. The cushion of claim 1 wherein said covering means is a single piece of pliable plastic material.

3. The cushion of claim 1 wherein said air controlling means includes a plurality of vents in said covering means.

4. The cushion of claim 1 including means for securing said covering means to said container.

5. The cushion of claim 4 wherein said securing means includes a lip on said covering means.

6. A cushion having improved dynamic resistance to applied forces for packaging an article in a container comprising:

compressible foam material having a top, a bottom and a plurality of sides;

pliable non-porous cover contiguously surrounding said top and said sides of said foam material;

said cover including a lip near said bottom of said foam material for securing said cover to said container; and a plurality of air vents in said cover near said lip for controlling the escape of air from said cushion when said cushion is compressed.

7. The cushion of claim 6 wherein said cover surrounds said bottom of said foam material.

8. The cushion of claim 6 wherein said sides of said foam material include a first side, a second side and two ends adjacent said first and second sides.

9. The cushion of claim 8 wherein said first and second sides are approximately two inches high and four inches long, said ends are approximately two inches high and three inches long, and said air vents are approximately three-quarter inch high and one-quarter inch long.

10. A package for articles having improved dynamic resistance to applied forces comprising a container and a plurality of cushions secured to the inside of said container, said cushions comprising compressible foam material, pliable non-porous covering means for contiguously covering said foam material, and air flow controlling means in said covering means controlling the escape of air from said foam material when said foam material is compressed, whereby said article is supported by said cushions and is held snugly in place by said cushions when said container is closed.

11. The package of claim 10 wherein said air controlling means includes a plurality of vents in said covering means.

12. The package of claim 10 wherein said cushions include a lip for securing said cushions to said container.

* * * * *